US008092282B2

(12) United States Patent
Bergstrand et al.

(10) Patent No.: US 8,092,282 B2
(45) Date of Patent: Jan. 10, 2012

(54) DEVICE FOR DRIVING A GRINDING MACHINE

(75) Inventors: Claes-Göran Bergstrand, Kullavik (SE); Odd Kjos, Älvängen (SE)

(73) Assignee: Scanmaskin Sverige AB, Lindome (SE)

( * ) Notice: Subject to any disclaimer, the term of this patent is extended or adjusted under 35 U.S.C. 154(b) by 418 days.

(21) Appl. No.: 12/515,177

(22) PCT Filed: Dec. 5, 2007

(86) PCT No.: PCT/SE2007/050942

§ 371 (c)(1), (2), (4) Date: May 28, 2009

(87) PCT Pub. No.: WO2008/069748

PCT Pub. Date: Jun. 12, 2008

(65) Prior Publication Data

US 2010/0015896 A1 Jan. 21, 2010

(30) Foreign Application Priority Data

Dec. 6, 2006 (SE) ..... 0602623-1

(51) Int. Cl.
*B24B 23/02* (2006.01)

(52) U.S. Cl. ..... 451/353; 451/359; 451/259

(58) Field of Classification Search ..... 451/259, 451/350, 351, 353, 359, 360, 362, 340; 15/49.1, 15/98

See application file for complete search history.

(56) References Cited

U.S. PATENT DOCUMENTS

| | | | | |
|---|---|---|---|---|
| 5,637,032 | A * | 6/1997 | Thysell et al. | 451/259 |
| 6,331,138 | B1 * | 12/2001 | Witters et al. | 451/340 |
| 6,540,596 | B1 * | 4/2003 | Van Der Veen | 451/350 |
| 6,783,447 | B2 * | 8/2004 | Van Vliet et al. | 451/353 |
| 7,226,347 | B1 * | 6/2007 | Padgett et al. | 451/353 |
| 7,241,210 | B2 * | 7/2007 | Van Vliet | 451/353 |
| 2007/0184762 | A1 * | 8/2007 | Dummermuth-Furter | 451/353 |

* cited by examiner

*Primary Examiner* — Dung Van Nguyen
(74) *Attorney, Agent, or Firm* — Potomac Patent Group PLLC

(57) ABSTRACT

The invention relates to a device (1) at a mobile grinding machine (2) for stone materials and that comprises a rotatably driven disc-shaped housing (3), which is arranged to support a plurality of grinding disc holders (6) rotatably driven by a belt (5) or chain driven by a motor (4), which holders are distributed along the circumference of said housing (3) and supported by shafts (11) connected to said housing (3) at a mutual distance from each other. According to the invention, internally (7) in a casing (8), which surrounds a said housing (3), a gear rim (10), situated concentrically with a centre driving shaft (9), is arranged non-turnably connected to the casing (8). The grinding disc holder shafts (11) support an intermediate coupling cogwheel (18) each that co-operates non-turnably with the appurtenant shaft and with said gear rim. The gear rim (10) has a through opening (19) for the shaft (9) driven by the motor (4), and between the gear rim (10) and the housing (3), formed of a grinding supporting drum, a seal (31) is arranged that extends along their outer periphery (10A, 3A). Upon driving actuation of the motor (4), it is accomplished that the grinding disc holders (6) and the housing (3) are driven to rotate in different directions (100 and 200, respectively) in relation to each other.

10 Claims, 5 Drawing Sheets

DEVICE FOR DRIVING A GRINDING MACHINE

Figure 1:
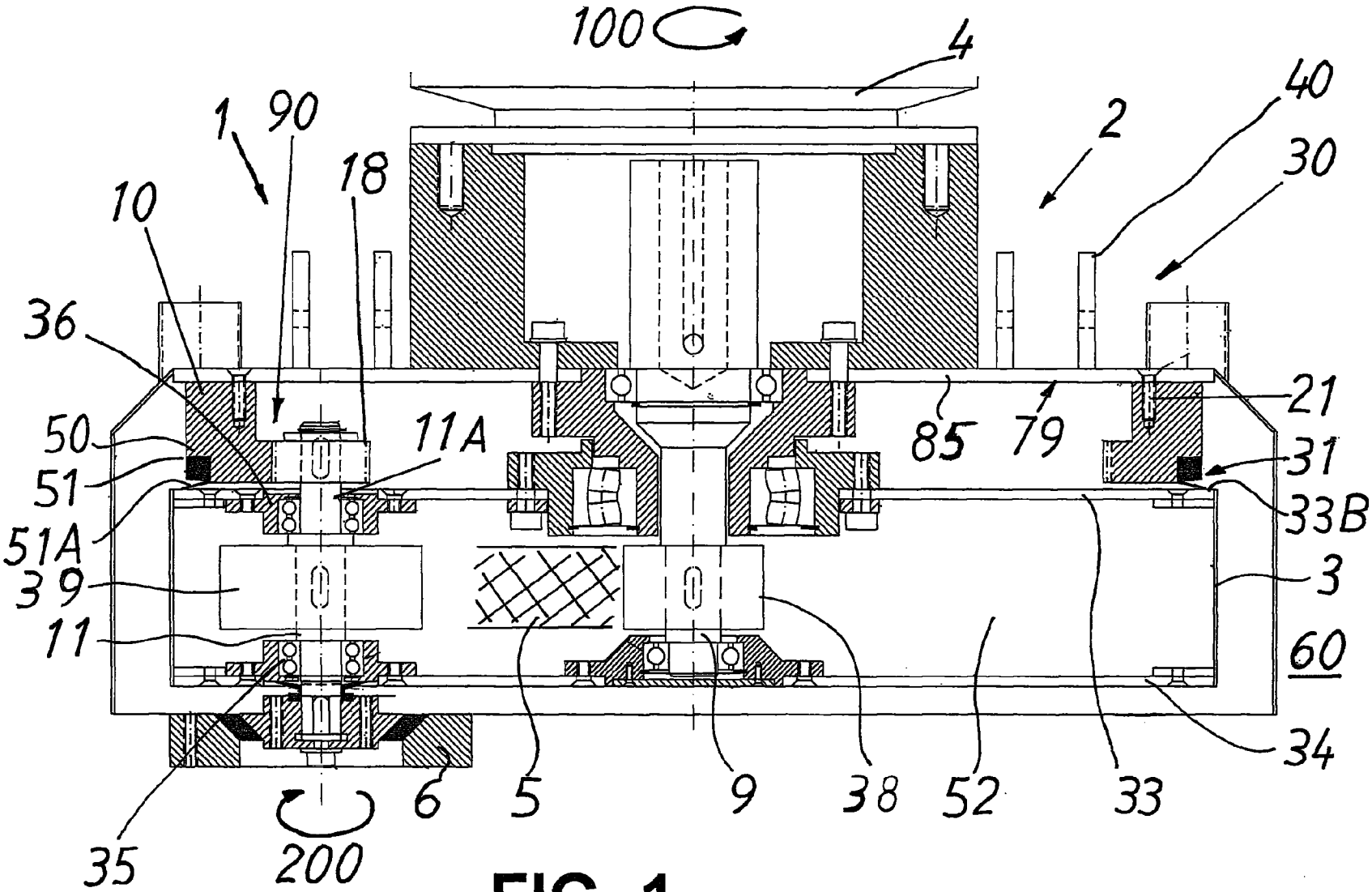

The present invention relates to a device at a mobile grinding machine for stone materials and other hard flooring materials and that comprises a rotatably driven disc-shaped housing, which is arranged to support a plurality of grinding disc holders rotatably driven by a belt or chain driven by a motor, which holders are distributed along the circumference of said housing and supported by shafts connected to said housing at a mutual distance from each other.

There are previously known various solutions to provide driving of rotatable grinding discs intended to grind stone and other hard materials that floors normally consist of. It is desired to provide driving of the housing that said grinding discs are rotatably supported by, but in a direction opposite to said housing in those cases the grinding machine cannot be of the type that said disc is caused to rotate by itself when the grinding discs are driven to rotate. It may namely happen that the disc stops to rotate and the grinding discs then dig themselves into the floor material, and then risk causing large and nasty undesired grinding marks in the floor material.

By RU 2268132 C1, a grinding disc device is previously known comprising a planetary gear in order to let rotationally drive grinding disc holders having grinding tools carried thereby so that these rotate in the direction opposite to which the housing is driven to rotate so as to obtain a smooth driving of the grinding disc holders in the desired direction. In that connection, no simple driving device is shown, but drives included are complicated and consist of many different parts.

Furthermore, by, for instance, SE 501 448 C2, a solution is previously known to drive the grinding discs to rotate in a common direction, counter-directed to the normal common direction of the grinding discs. Said driving is provided by means of driving belts. The environment that said grinding machine operates in is often dirty including much whirling dust that may affect the parts of the machine negatively. Belt driving in an unprotected state is neither always safe when it comes to operation of heavy parts. In that connection, this problem unfortunately remains.

Furthermore, by EP 0984845 B1, a grinding machine is previously known having rotatably driven grinding disc holders for grinding discs that are driven by a driving belt, etc., and that a housing, by which the grinding disc holders are supported driven in a common direction, is driven by a planetary gear to rotate in the opposite direction. A planetary gear is often a complicated transmission, and in a dusty and unclean environment, the operation is often affected negatively.

EP 1286806 B1 shows a grinding machine for floors having three grinding discs, which are rotatably driven in common direction. For driving of the grinding disc-supporting housing, there is an additional transmission situated outside said housing. Accordingly, neither there the environment is always the best, and that the transmission then preferably consists of driving bands, which particularly in dirty environments is not so good.

Therefore, the main object of the present invention is primarily to solve, among other things, the problems mentioned above in a floor-grinding machine in an efficiently and reliably working way and by simple means.

Said object is attained by means of a device according to the present invention that essentially is characterized in that, internally in a casing surrounding said housing, a gear rim, situated concentrically with a centre driving shaft is arranged non-turnably connected to the casing, that the grinding disc holder shafts support an intermediate coupling cogwheel each that co-operates non-turnably with the appurtenant shaft and with said gear rim, that the gear rim has a through opening for the shaft driven by the motor, that a seal is arranged between the gear rim and the grinding support drum and that extends along their outer periphery, upon driving actuation of the motor, it being accomplished that the grinding disc holders and the housing are driven to rotate in different directions in relation to each other.

Figure 2:
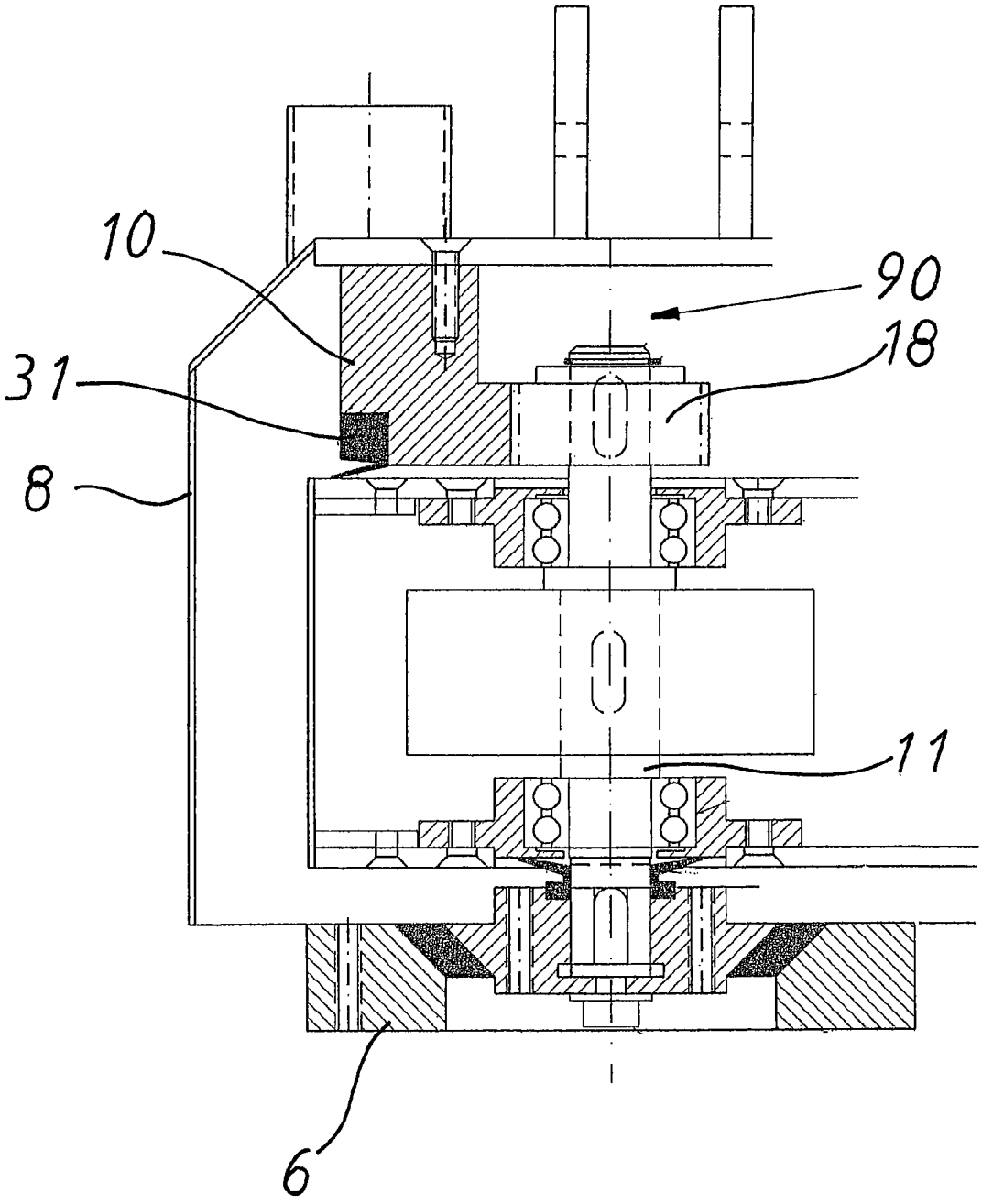
Figure 3:
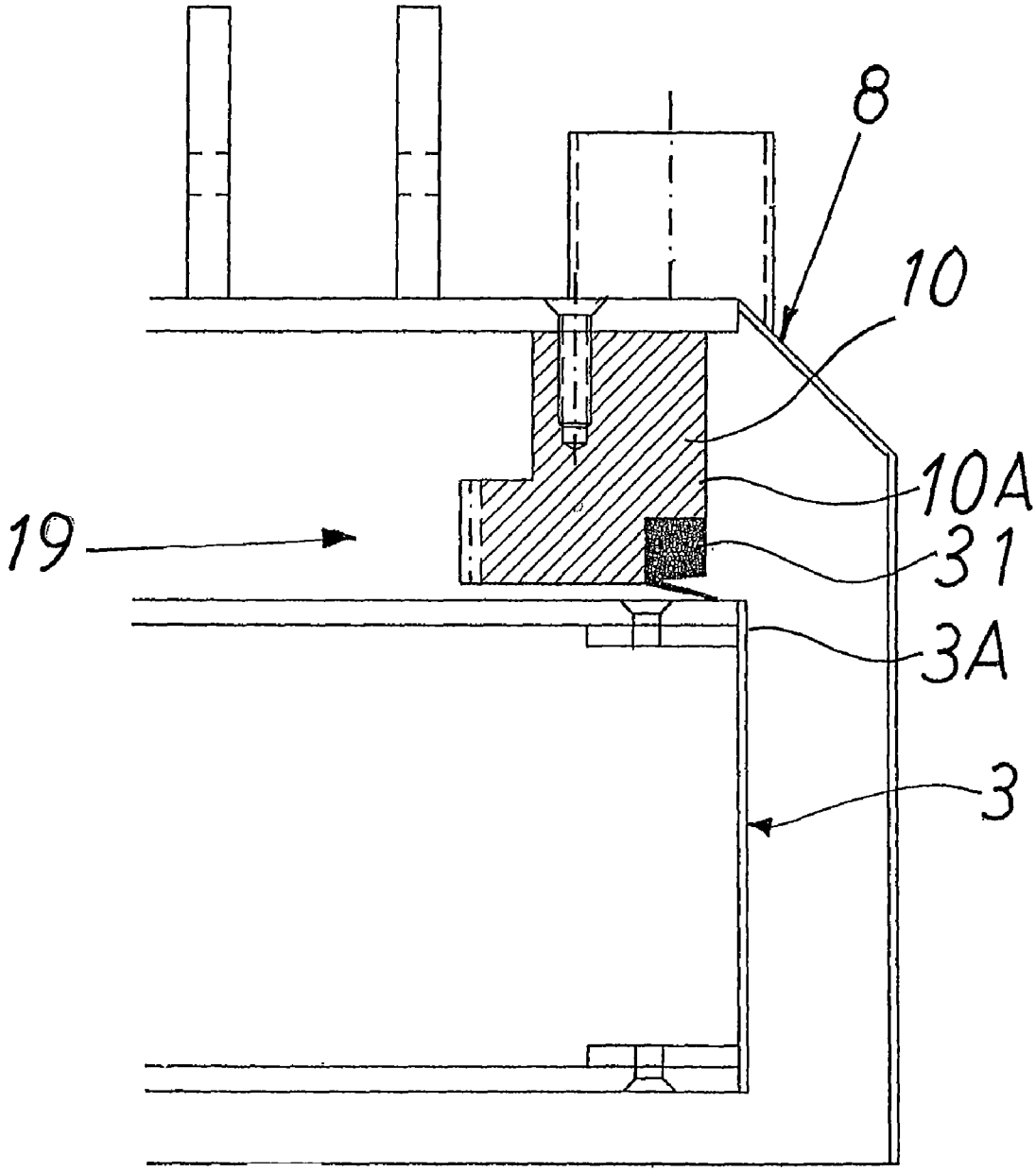
Figure 4:
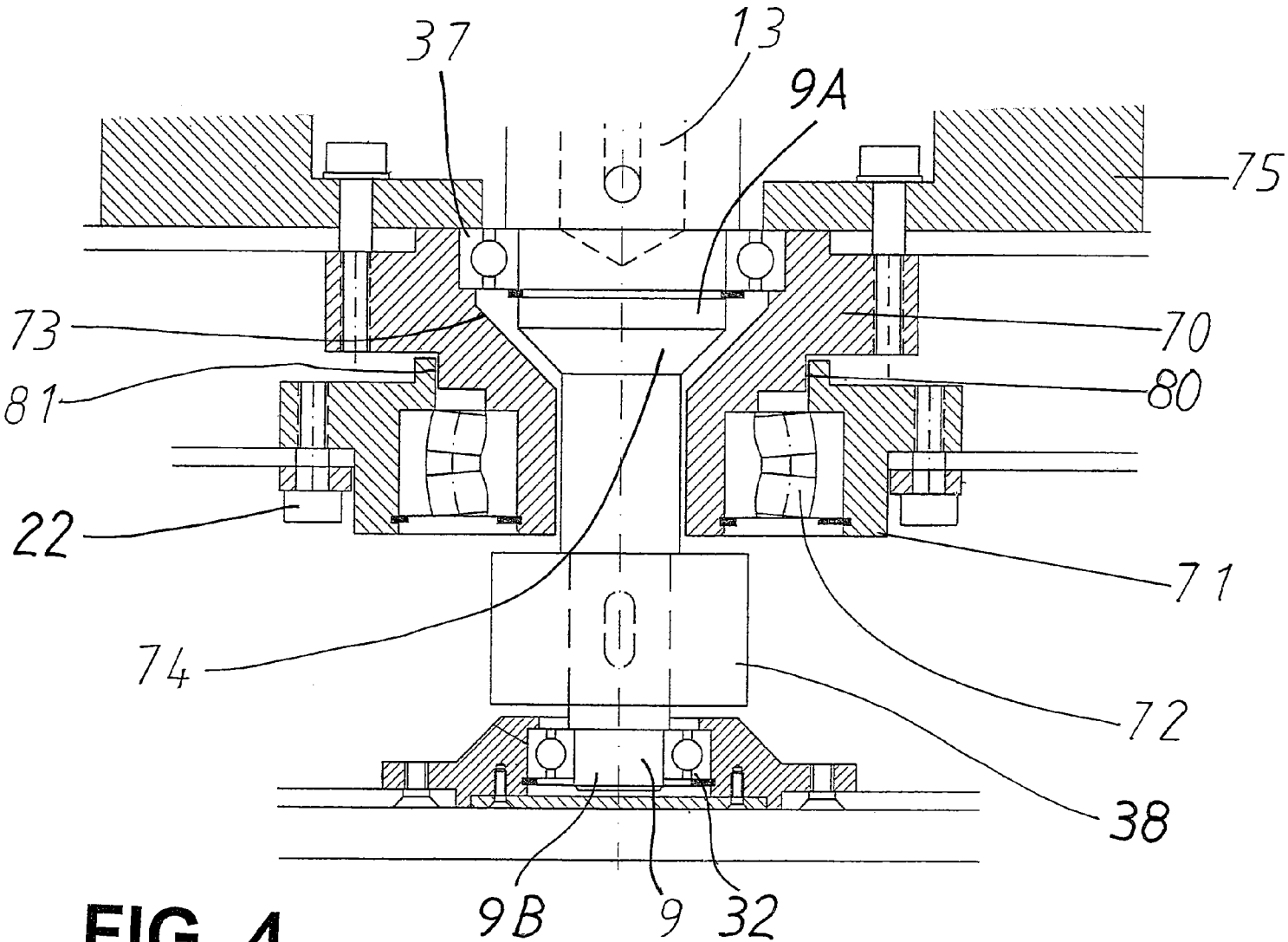
Figure 5:
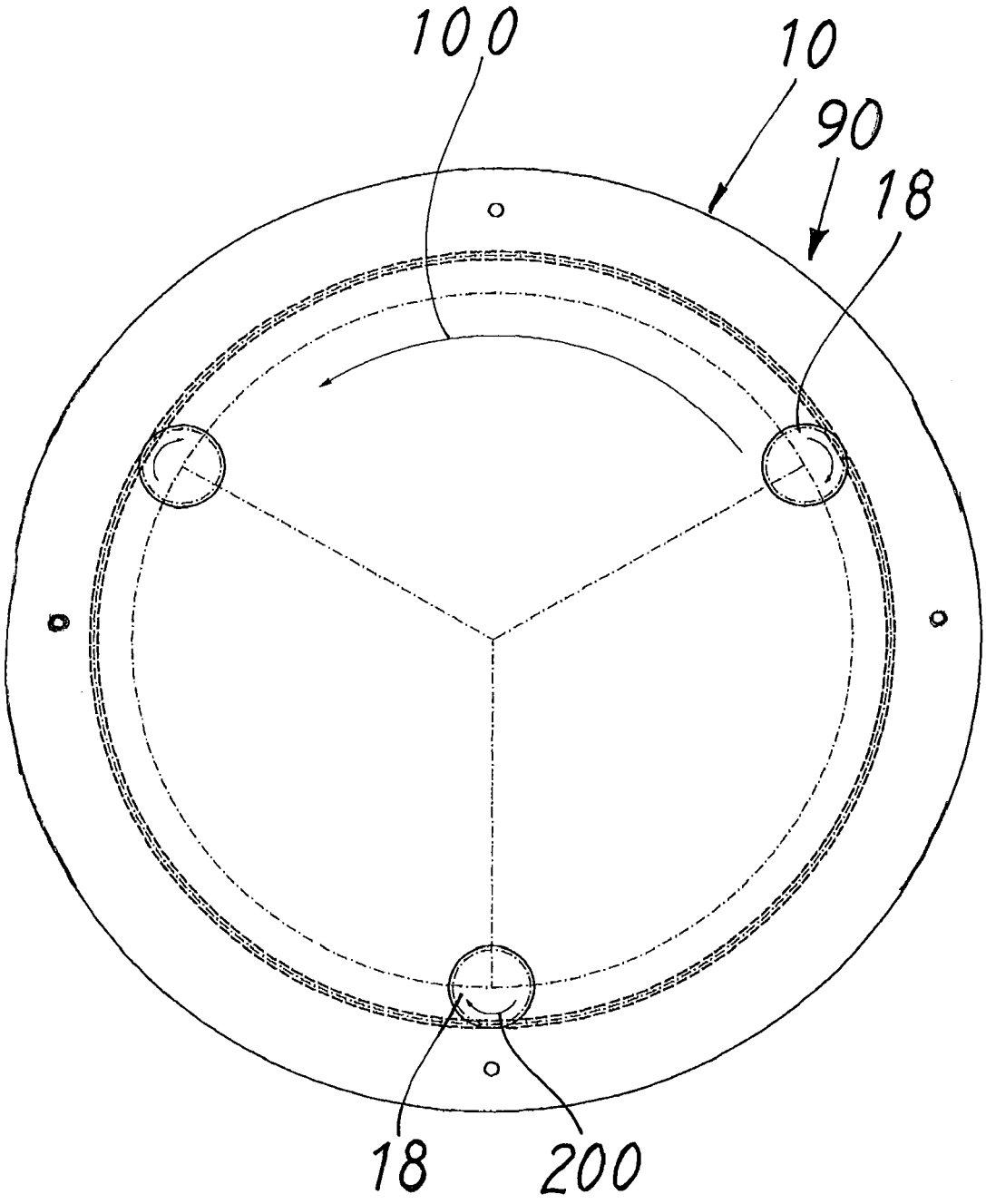

The present invention is described in the form of a preferred embodiment example, reference being made to the accompanying drawings, in which FIG. 1 shows a cross-section view of a grinding machine including a containing driving part, FIG. 2 shows in enlargement, at the area of a grinding disc holder, the drive mechanism of the machine and the included parts thereof at one side thereof, FIG. 3 shows a schematic section view through the machine at the area of the other side thereof, FIG. 4 schematically shows the drive mechanism for driving the grinding disc holders at the area of the centre area thereof, and FIG. 5 shows a schematic planar view of driving members included in the driving device.

A mobile grinding machine 2 according to the present invention, and of which only the proper grinding and driving part of the machine are shown in the drawings, is formed of, in addition to a handle, not shown, a rotatably driven disc-shaped housing 3, a motor 4 preferably powered by electricity, and a surrounding stable frame 30 and attachments 40 for detachable fastening on said frame 30 to make the grinding machine 2 easy to handle upon, among other things, transportation of the same.

According to the invention, a device 1 for driving is intended to be present in a said mobile grinding machine 2, intended to process stone materials and other hard flooring materials, in order to be able to provide efficient driving of rotating parts included in the machine 2 when this is desirable, and a self-propelled grinding machine is not enough. Said grinding machine 2, which comprises a rotatably driven disc-shaped housing 3, which is arranged to support at least three or more grinding disc holders 6 rotatably driven by a motor 4, distributed evenly along the circumference of said housing 3, and supported driven by a preferably common belt 5 or chain and supported by shafts 11 connected to said housing 3 at a mutual distance from each other, comprises a separate drive mechanism 90 to provide driving of said disc-shaped housing 3 in a direction 100 opposite the direction 200 in which the grinding disc holder 6 is driven to rotate by the drive shaft 9 of the motor and in the direction 100 of rotation of said shaft 9. Said drive mechanism 90 is formed of a centrally situated gear rim 10 received internally 52 in said housing 3 and protectively arranged against the dirty environment of the surrounding 60, which gear rim is arranged non-turnably connected to a downwardly open casing 8, which surrounds said housing 3.

Said gear rim 10 is arranged to be rotationally driven by means of the cogwheels 18 co-operating with said gear rim 10 to let rotate the grinding disc holders 6 in the intended desired driving direction 200, which direction 200 is opposite the driving direction 100 of the motor.

At the upper end 11A thereof, the grinding disc holder shafts 11 support an intermediate coupling cogwheel 18 each that co-operates non-turnably with the appurtenant shaft 11 and with said central gear rim 10. Thus, upon driving actuation of the motor 4, it is accomplished by said drive mechanism 90 that the grinding disc holders 6 and the housing 3 are driven to rotate in different directions 200 and 100, respectively, in relation to each other. The circular gear rim 10 has a through opening 19 for the receipt of the shaft 9 driven by the motor 4 and the output shaft 13 thereof, and is attachable by means of screws 21 to a bearing box 71 that in turn is attachable by means of bolts 22 to the housing 3.

Said disc-shaped hole-shaped housing 3 is formed of a cylindrical drum having bearings 27, 37 for the shaft 9 of the motor that are supported at the opposite walls 33, 85 of the housing and casing, respectively. The shafts 11 for the grinding disc holders 6 and the intermediate coupling wheels 18 are evenly distributed along the circumference of the lower wall 34 of said housing and supported by a bearing 35, 36 each, which are supported by the lower and upper wall 34, 33, respectively, of the drum.

A connecting centre shaft 9 is interconnectable with the output shaft 13 of the motor so as to provide a simple connection of the motor 4 to the frame 30 and the housing 3. At the respective end 9A, 9B of said shaft 9, each a bearing 37, 32 is received as well as that a driving pulley 38 or a chain cogwheel is supported at the lower end 9B thereof while a interconnectable drivable pulley 39 or chain cogwheel is supported by the respective housing-supported shaft 11. A belt stretcher, etc., may also be arranged at said driving belt etc., 5.

Said gear rim 10 is arranged attachable by means of screws 21 received on the inside 79 of the upper wall 85 of the casing 8.

Furthermore, the gear rim 10 supports said seal 31 at the lower circumference edge 50 of the gear rim in an annular recess 51 shape-adapted to the sealing ring 31, while the annular flexible lip 51A of the seal abuts against the upper outside 33B of the upper wall 33 of the housing 3. Thus, said seal 31 is arranged between the gear rim 10 and the housing 3, formed of a grinding supporting drum, extending along their outer periphery 10A, 3A.

An inner bearing box 70, which is attached to the inside of a hood 75 that the frame also is formed of, is arranged to co-operate sealingly with an outer bearing box 71. Said bearing boxes 70, 71 are arranged to be formed of bearing sleeves detachably coupled to the casing 8 and to the housing 3, respectively, between which sleeves bearing roll members 72 are received. One of the bearing sleeves 70 is shape-adapted 73 to receive the conical portion 74 of the shaft 9 as well as a bearing 37 therein. A connecting centre shaft 13 of the motor is interconnectable with the output shaft 9 of the motor 4.

Internally in said outer bearing box 71, a shaft guiding part 80 is arranged, which is receivable by the inner bearing box 70 and which shaft guiding part 80 with the circumference portion is arranged to co-operate with a surrounding congruent fastening portion 81 of the outer bearing box 71 attached to the housing.

The function of the device should have been understood from what has been said above, but the principle may be explained briefly: Driving of the motor 4 actuates the output shaft 13 of the motor to drive the drive shaft 9 connected therewith so that the same rotates in, for instance, the counter-clockwise direction 100. The pulley 38 is driven to actuate the driving belt 5 to be driven in the direction 40 so that connected pulleys 39 are actuated to drive the respective shaft 11 in the same direction.

Thereby, via the preferably inwardly turned teeth thereof, the gear rim 10 co-operates with said rotatably driven cogwheels 18 on the upper ends 11A of the shafts 11. Thereby, the entire housing 3 is actuated to rotate in the opposite direction 200 to the direction 100 in which the cogwheels 18 are driven to rotate by the motor 4. This is thanks to the gear rim being attached on the non-turnable casing 8 that forms a part of the frame of the machine.

In that connection, a dustless, simple and reliably working drive mechanism is attained to be provided by the invention.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A device at a mobile grinding machine for stone materials and other hard flooring materials that includes a rotatably driven disc-shaped housing arranged to support a plurality of grinding disc holders rotatably driven by a motor, which holders are distributed along a circumference of the housing and are supported by shafts connected to the housing at a mutual distance from each other, the device comprising:

a gear rim disposed internally in a casing surrounding the housing, situated concentrically with a driven center shaft, and non-turnably connected to the casing;

at least one intermediate coupling cogwheel, wherein each shaft supporting a grinding disc holder supports an intermediate coupling cogwheel that cooperates non-turnably with the respective shaft and with the gear rim; and a seal arranged between the gear rim and the housing, formed of a grinding supporting drum, and extending along their outer peripheries;

wherein the gear rim has a through opening for the shaft driven by the motor, and upon being driven by the motor, the grinding disc holders and the housing are driven to rotate in different directions in relation to each other.

2. The device of claim 1, wherein the housing is formed of a cylindrical drum having bearings for an output shaft of the motor supported at the center thereof, and the bearings are diametrically opposite each other at opposite upper and lower walls of the housing.

3. The device of claim 2, wherein the gear rim is attachable by screws on an inside of the upper wall of the casing.

4. The device of claim 1, wherein the gear rim supports the seal at a lower circumference edge of the gear rim in a shape-adapted annular recess.

5. The device of claim 4, wherein the shafts supporting the grinding disc holders and intermediate coupling cogwheels are evenly distributed along the circumference of the lower wall of the drum.

6. The device of claim 1, further comprising an inner bearing box that is attached to an inside of a hood that a frame also is formed of, wherein the inner bearing box is arranged to co-operate sealingly with an outer bearing box.

7. The device of claim 6, wherein a connecting centre shaft of the motor is inter-connectable with an output shaft.

8. The device of claim 1, wherein a shaft that supports a respective grinding disc holder is sealed inward toward an inner space of the housing.

9. The device of claim 1, further comprising bearing sleeves detachably connected to the casing and to the housing, between which bearing sleeves bearing roll members are received.

10. The device of claim 9, wherein a bearing sleeve is shape-adapted to receive therein a conical portion of a grinding disc holder shaft and a bearing.

* * * * *